US006890056B2

(12) United States Patent
Johnson et al.

(10) Patent No.: US 6,890,056 B2
(45) **Date of Patent: *May 10, 2005**

(54) PRINT CARTRIDGE SERVICING FOR AN INKJET PRINTING SYSTEM USING STATIONARY PRINT CARTRIDGES

(75) Inventors: Eric Joseph Johnson, San Diego, CA (US); Robert W Beauchamp, Cartsbad, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/335,122

(22) Filed: Dec. 31, 2002

(65) Prior Publication Data

US 2003/0174185 A1 Sep. 18, 2003

Related U.S. Application Data

(62) Division of application No. 09/494,725, filed on Jan. 31, 2000, now Pat. No. 6,585,347.

(51) Int. Cl.[7] ..... B41J 2/165

(52) U.S. Cl. ..... 347/32; 347/29; 347/30; 347/33

(58) Field of Search ..... 347/22–35

(56) References Cited

U.S. PATENT DOCUMENTS 5,040,000 A * 8/1991 Yokoi ..... 347/30
5,206,666 A * 4/1993 Watanabe et al. ..... 347/3
5,589,865 A * 12/1996 Beeson ..... 347/28
5,594,477 A * 1/1997 Hilton ..... 347/30
5,757,398 A * 5/1998 Anderson ..... 347/32
6,019,466 A * 2/2000 Hermanson ..... 347/104

* cited by examiner

*Primary Examiner*—Shih-Wen Hsieh

(57) ABSTRACT

Print cartridges on printers using stationary print cartridges are accessed by service station components such as wipers, scrapers, cleaning fluid applicators, ink receiving receptacles and cappers in a manner similar to what is done in a conventional scanning printhead printing system. A print cartridge support structure holds one or more print cartridges in a stationary position while applying ink on a media. A printhead is located on each of the print cartridges. The printhead has nozzles for ejecting ink which are arranged in a nozzle array of one or more columns of nozzles. A media movement mechanism provides movement of the media though a print zone located beneath the nozzle array. A printhead servicing station is located outside of the print zone and has one or more servicing modules dedicated for interaction with one of the nozzle arrays when the one of the nozzle arrays is positioned in aligned proximity with its dedicated servicing module. A motorized device coupled to the print cartridge support structure moves the print cartridge support structure out of the print zone to the service station during a period when the print cartridges are not applying ink to the media.

20 Claims, 16 Drawing Sheets

PRINT CARTRIDGE SERVICING FOR AN INKJET PRINTING SYSTEM USING STATIONARY PRINT CARTRIDGES

This application is a division of U.S. Ser. No. 09/494,725, filed Jan. 31, 2000, now U.S. Pat. No. 6,585,347.

CROSS-REFERENCE TO RELATED APPLICATIONS

This application is related to U.S. patent application Ser. No. 09/167,392, filed Oct. 6, 1998, entitled "Modular Print Cartridge Receptacle for Use in Inkjet Printing Systems" and U.S. patent application Ser. No. 09/167,394, filed Oct. 6, 1998, entitled "Inkjet Printing Systems Using a Modular Print Cartridge Assembly" which are herein incorporated by reference.

FIELD OF THE INVENTION

This invention relates to inkjet printers using stationary print cartridges and, more particularly, to servicing stationary print cartridges in an inkjet printing system.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the media.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filling of a pattern of dot locations with dots of ink.

Inkjet hardcopy devices print dots by ejecting very small drops of ink onto the print medium and typically include a movable carriage that supports one or more print cartridges each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. Properly sequencing the operation of each nozzle causes either to eject ink or to refrain from ejecting ink according to the output of the controlling microprocessor to cause characters or images to be printed upon the media as the printhead moves past the media or the media moves past the printhead.

Color inkjet hardcopy devices commonly employ a plurality of print cartridges, usually two to four, mounted in the printer cartridge to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a dot location, while secondary or shaded colors are formed by depositing multiple drops of different base color inks onto the same dot location, with the overprinting of two or more base colors producing the secondary colors according to well established optical principles.

For many applications, such as personal computer printers and fax machines, the ink reservoir has been incorporated into the pen body such that when the pen runs out of ink, the entire pen, including the printhead, is replaced.

However, for other hardcopy high volume printing applications, such as large format plotting of engineering drawings, color posters and the like, there is a requirement for the use of much larger volumes of ink than can be contained within the replaceable pens. Therefore, various off-board ink reservoir systems have been developed recently which provide an external stationary ink supply connected to the scanning cartridge via a tube. The external ink supply is typically known as an "off-axis," "off-board," or "off-carriage" ink supply.

There is a trend to use inkjet printing in new specialized printing systems which are very different systems compared to desk-top printers and facsimile machines, or from large format plotters. These specialized printing systems include applications, such as postal printing, postal franking, label printing and bar code printing. Currently, there are no means to design a specialized printing system without a substantial engineering effort.

In typical inkjet printers the inkjet print cartridges containing the nozzles are scanned or moved repeatedly across the width of the medium to be printed upon. During this movement across the medium, each of the nozzles is caused either to eject ink or to refrain from ejecting ink according to the program output of the controlling microprocessor. Each completed scan or movement across the medium can print a swath approximately as wide as the number of nozzles arranged in a column of the ink cartridge multiplied times the distance between nozzle centers. After each such completed movement or swath the medium is moved or advanced forward the width of the swath, and the ink cartridge begins the next swath.

In inkjet printers the print cartridges need to be periodically serviced. In a scanning carriage printer, a service station is normally located in the scan direction past the edge of the media, since because the scan direction motion is required for printing, it is natural to expand that motion and locate the service station in that direction out of the print zone. Accordingly, when servicing is required, the print cartridges move past the edge of the medium to the location of the service station for servicing.

In printing systems which use stationary print cartridges for printing (such as for example, ticket, tag, label and mail printing), there is no scan direction motion because the print cartridges remain in a fixed or stationary position during printing. In addition, in typical stationary printhead printing systems there may be media movement and drive system mechanisms which make accessing the print cartridges difficult. Because of these difficulties, many stationary printhead printing systems do not use service stations. The disadvantage of this approach is that the performance of the printhead decreases as nozzles become dried and ink residue builds up on the printhead orifice plate. Accordingly, periodically it is necessary for an operator technician to manually remove the print cartridges and manually clean the orifice plates. This type of operation is not well controlled and depends on user know-how and consistent execution and exposes the printheads to damage if done incorrectly.

Accordingly, there is a need for a solution to the servicing of print cartridges in specialty printing systems which often use print cartridges which are stationary during the printing operation with only the media moving through the print zone. With stationary printhead printers, a new means for making the print cartridges accessible to service station components is required.

SUMMARY OF THE INVENTION

The present invention enables the print cartridges on printers using stationary print cartridges to be accessed by service station components such as wipers, scrapers, cleaning fluid applicators, ink receiving receptacles and cappers. The advantage of the present invention is that enables the print cartridges on stationary printhead printing system to be serviced in a manner similar to what is done in a conventional scanning printhead printing system. The benefits of correctly servicing the inkjet print cartridges are increased printhead quality, increased printhead life, more consistent performance over a wide range of environmental conditions, and reduced operator intervention such as manually clean and replacing print cartridges. The present invention includes a print cartridge support structure for holding one or more print cartridges in a stationary position while applying ink on a media. A printhead is located on each of the print cartridges. The printhead has nozzles for ejecting ink which are arranged in a nozzle array of one or more columns of nozzles. A media movement mechanism provides movement of the media though a print zone located beneath the nozzle array. A printhead servicing station is located outside of the print zone and has one or more servicing modules dedicated for interaction with one of the nozzle arrays when the one of the nozzle arrays is positioned in aligned proximity with its dedicated servicing module. A motorized device coupled to the print cartridge support structure moves the print cartridge support structure out of the print zone to the service station during a period when the print cartridges are not applying ink to the media.

BRIEF DESCRIPTION OF THE DRAWINGS

FIG. 1 comprising

DETAILED DESCRIPTION OF THE PREFERRED EMBODIMENTS

Figure 1A:
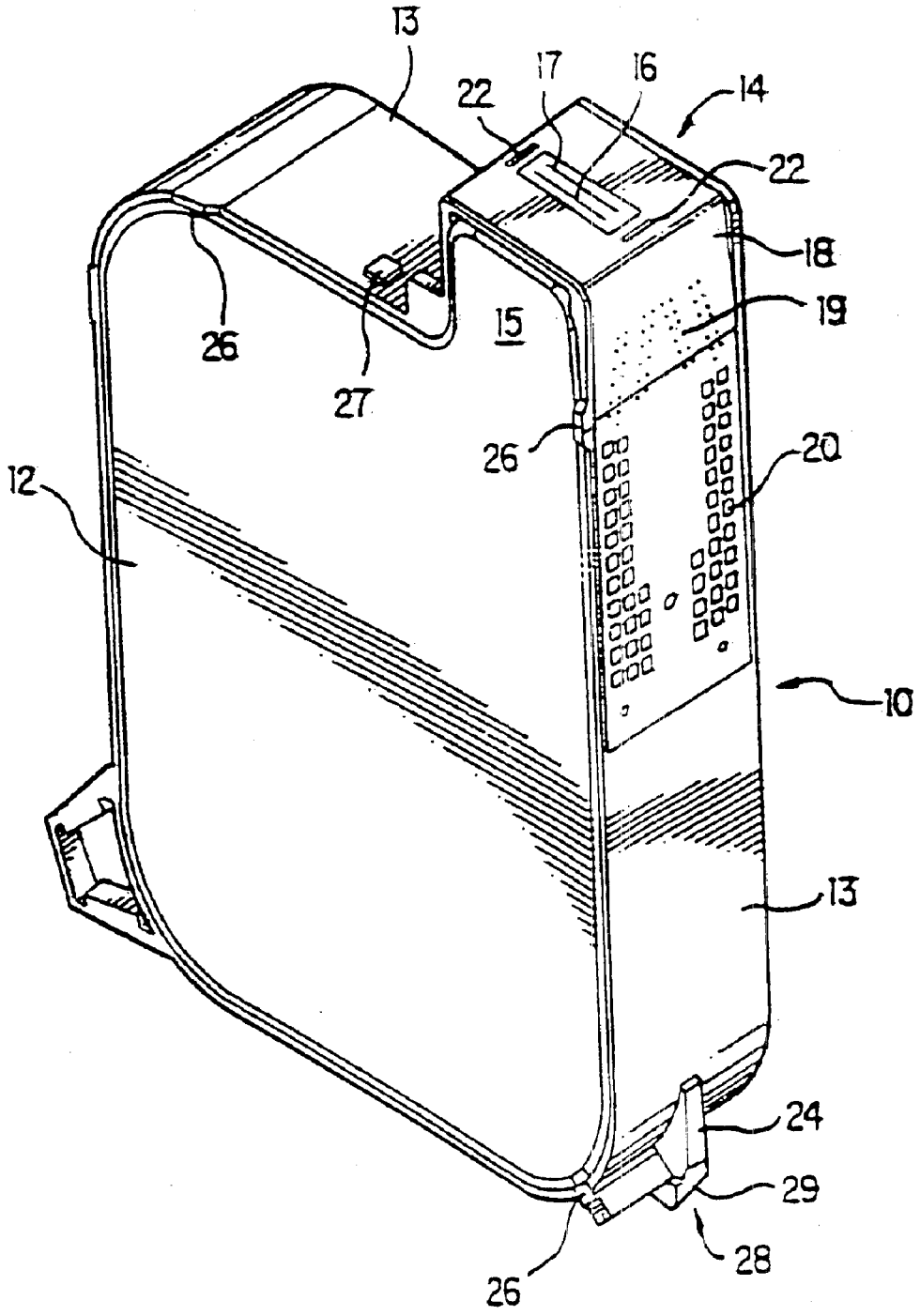
FIGS. 1A, 1B and 1C are perspective views of a first inkjet print cartridge which can be used with the present invention as seen from the bottom rear, top rear and bottom front, respectively.

Referring to FIGS. 1A. 1B and 1C, shown is an inkjet print cartridge 10 which maybe used in the present invention. The inkjet print cartridge 10 includes two side walls 12 and a perimeter wall 13 and a printhead 14 affixed to the "snout" portion 15 of the perimeter wall 13. The printhead 14 includes a nozzle member 16 comprising two parallel columns of offset holes or orifices 17 formed in a flexible polymer flexible circuit 18 by, for example, laser ablation.

The flexible circuit 18 is bent over the back edge of the print cartridge "snout" and extends down the back perimeter wall of the snout. This flap portion of the flexible circuit 18 is needed for the routing of conductive traces 19 which are connected to substrate electrodes (not shown). The contact pads 20 are located on the flexible circuit 18 which is secured to the back of perimeter wall 13 and the conductive traces 19 are routed over the bend and are connected to the substrate electrodes.

Printhead 14 has affixed to the back of the flexible circuit 18 the silicon substrate containing a plurality of individually energizable thin film resistors. Each resistor is located generally behind a single orifice 17 and acts as a heater resistor for ejecting ink droplets when selectively energized by one or more pulses applied sequentially or simultaneously to one or more of the contact pads 20.

Windows 22 extend through the flexible circuit 18 and are used to facilitate bonding of the conductive traces 19 to the electrodes on the silicon substrate. The windows 22 are filled with an encapsulant after bonding the conductive traces 19 to the electrodes on the silicon substrate to protect any underlying portion of the traces and substrate.

A demultiplexer (not shown) may be formed on the substrate for demultiplexing the incoming multiplexed signals and distributing the address and primitive signals to the heater resistors. The demultiplexer demultiplexes the incoming electrical signals into signals to be applied to the heater resistors to selectively energize the various heater resistors to eject droplets of ink from nozzles 17 on a receiving media in the print zone.

The demultiplexer enables the use of fewer contact pads 20 than heater resistors. Further details regarding multiplexing are provided in U.S. Pat. No. 5,541,269, issued Jul. 30, 1996, entitled "Printhead with Reduced Interconnections to a Printer," which is herein incorporated by reference.

Preferably, an integrated circuit logic using CMOS technology can be placed on the substrate in place of the demultiplexer in order to decode more complex incoming data signals than just multiplexed address signals and primitive signals, thus further reducing the number of contact pads 20 required. The incoming data signals are decoded by the integrated logic circuits on the printhead into address line and primitive firing signals. Performing this operation in the integrated logic circuits on the printhead increases the signal processing speed and the firing frequency of the printhead.

The back surface of the flexible circuit 18 includes conductive traces 19 formed thereon using a conventional photolithographic etching and/or plating process. These conductive traces are terminated by contact pads 20 designed to interconnect with a modular print cartridge receptacle described below. The print cartridge 10 is designed to so that the contact pads 20, on the front surface of the flexible circuit 18, contact electrodes when the print cartridge is installed in a modular print cartridge receptacle.

The print cartridge 10 also includes datums for accurately aligning the print cartridge and the nozzle member 16 in the modular print cartridge receptacle of the present invention discussed below. The print cartridge 10 is provided with three datum surfaces 26 located on the perimeter of a sidewall of print cartridge 10 and sufficiently spaced apart from each other to provide accurate and stable alignment. The print cartridge is also provided with a forwardly facing fourth datum surface 25 located on the front lower portion of the snout and with a downwardly facing fifth datum surface 27 on the perimeter wall of the print cartridge adjacent the fourth datum surface, so as to establish a pivot axis above and in front of the snout, and with a rearwardly facing sixth datum surface 24 on the upper end of the print cartridge perimeter wall 13, the fifth datum surface 25 is used to determine the spacing of the nozzle to the print medium and the sixth datum surface is used to determine angular orientation of the print cartridge about a pivot point.

Alignment between two or more nozzle plates affixed to print cartridges installed in a modular print cartridge receptacle is achieved by machining datum projections 24–27 on each print cartridge after its nozzle plate 16 has been permanently secured to the print cartridge. The machined datum projections 24–27 on the print cartridge contact mating surfaces on a modular print cartridge receptacle described below when print cartridge 10 is installed in the modular print cartridge receptacle. The datums affect the position of the cartridge 10, and hence the nozzle plate 16, within the modular print cartridge receptacle. Print cartridge 10 also has a latch engaging portion 28 having an angled surface 29 between the horizontal and vertical directions for engaging with a latching mechanism on the modular print cartridge receptacle to be described below.

For further details regarding the datums see U.S. Pat. No. 5,646,665 entitled "Side Biased Datum Scheme for Inkjet Cartridge and Carriage;" U.S. Pat. No. 4,907,018 entitled "Printhead-carriage Alignment and Electrical Interconnect Lock-in mechanism" U.S. Pat. No. 5,617,128 entitled "Alignment of Multiple Nozzle Members in a Printer;" and U.S. Pat. No. 5,408,746 entitled "Datum Formation for Improved Alignment of Multiple Nozzle Members in a Printer," which are herein incorporated by reference.

Figure 1B:
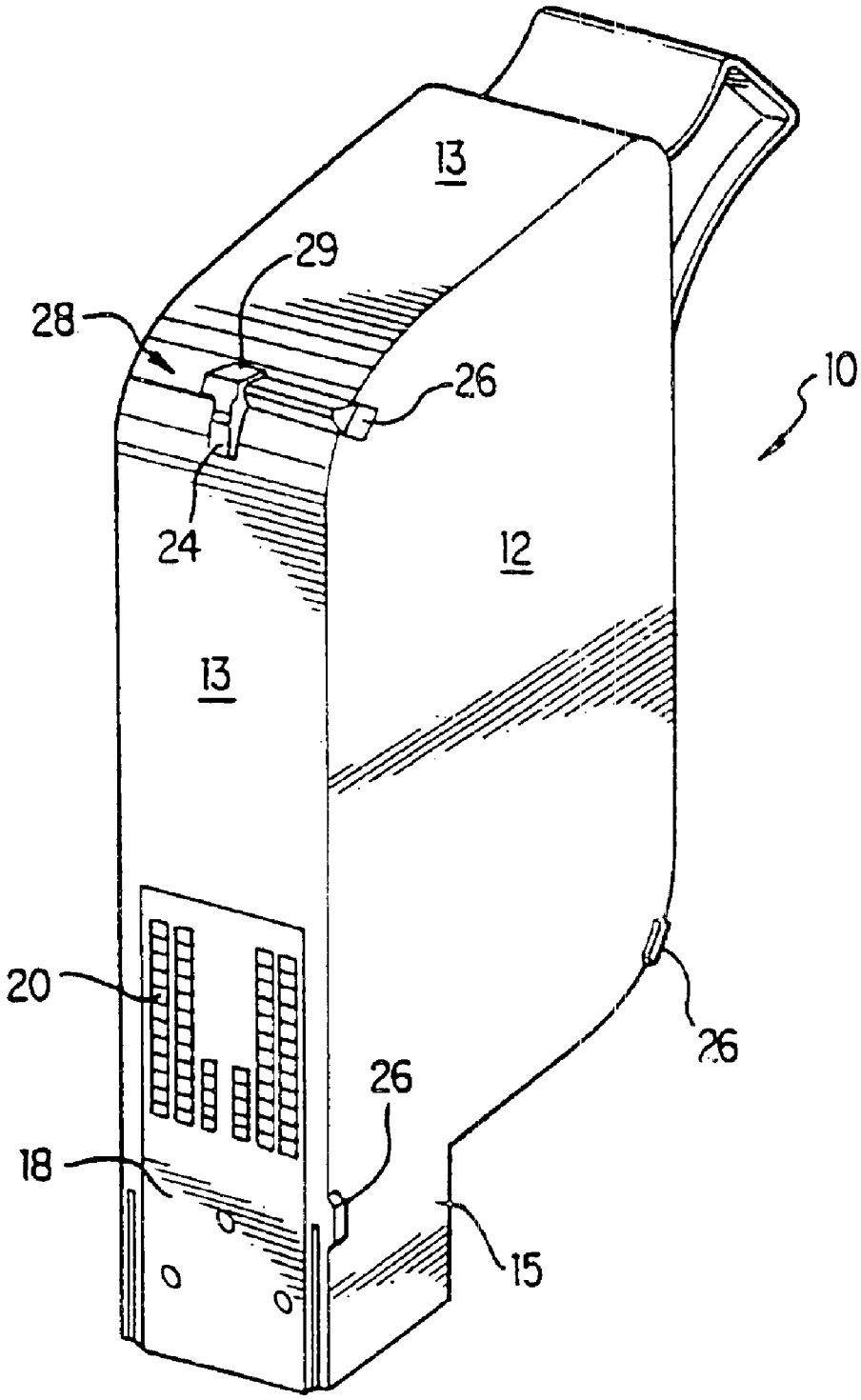
Figure 1C:
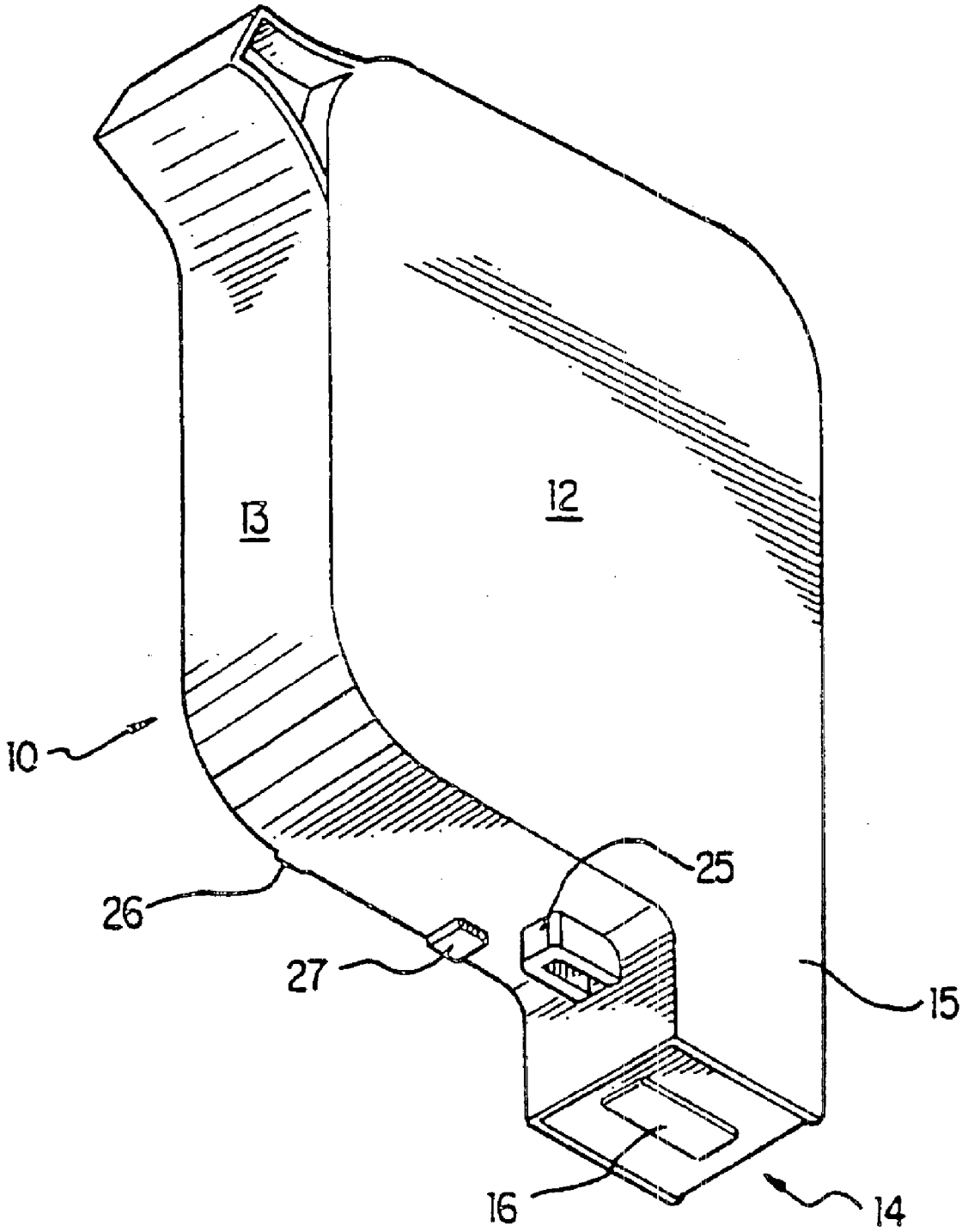

While print cartridge 10 is shown in FIG. 1 has an integral ink supply, print cartridge 10 is readily modified to receive ink from an off-axis ink supply. See, U.S. Pat. No. 5,675,367 entitled "Inkjet Print Cartridge Having Handle Which Incorporates an Ink Fill Port;" Wu, et al., U.S. patent application Ser. No. 09/045,151, filed Mar. 19, 1998, entitled "Alignment Coupling Device for Manually Connecting an Ink Supply to an Inkjet Print Cartridge" and Wu, et al., U.S. patent application Ser. No. 09/045,150, filed Mar. 19, 1998, entitled "Ink Replenishment System with an Open-valve Printhead Fill Port Continuously Connected to an Ink Supply" which are herein incorporated by reference.

Figure 2:
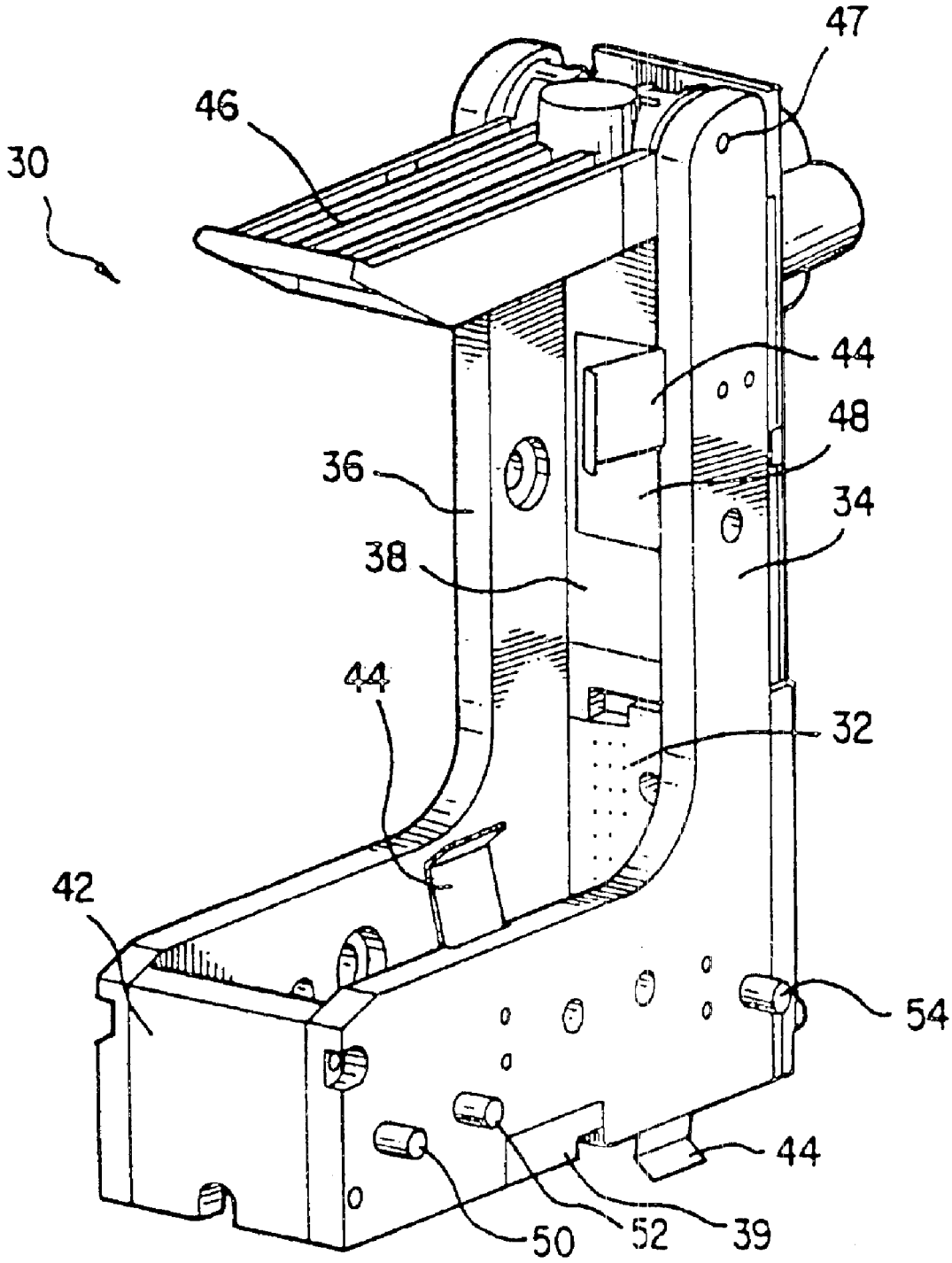
FIG. 2 is a perspective front right view of a singular modular print cartridge receptacle of the present invention.
Figure 3:
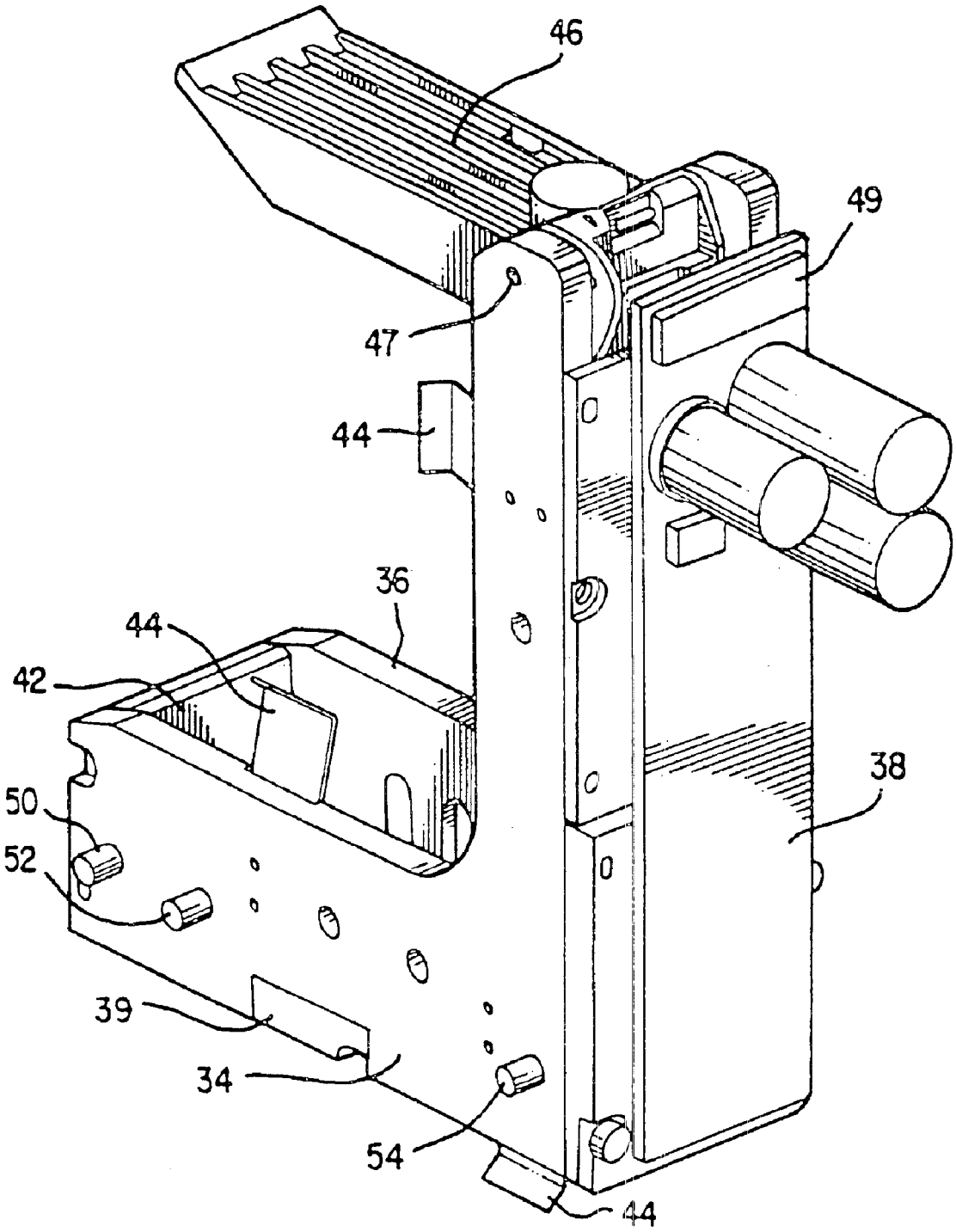
FIG. 3 is a perspective back right view of a singular modular print cartridge receptacle of the present invention.
Figure 4:
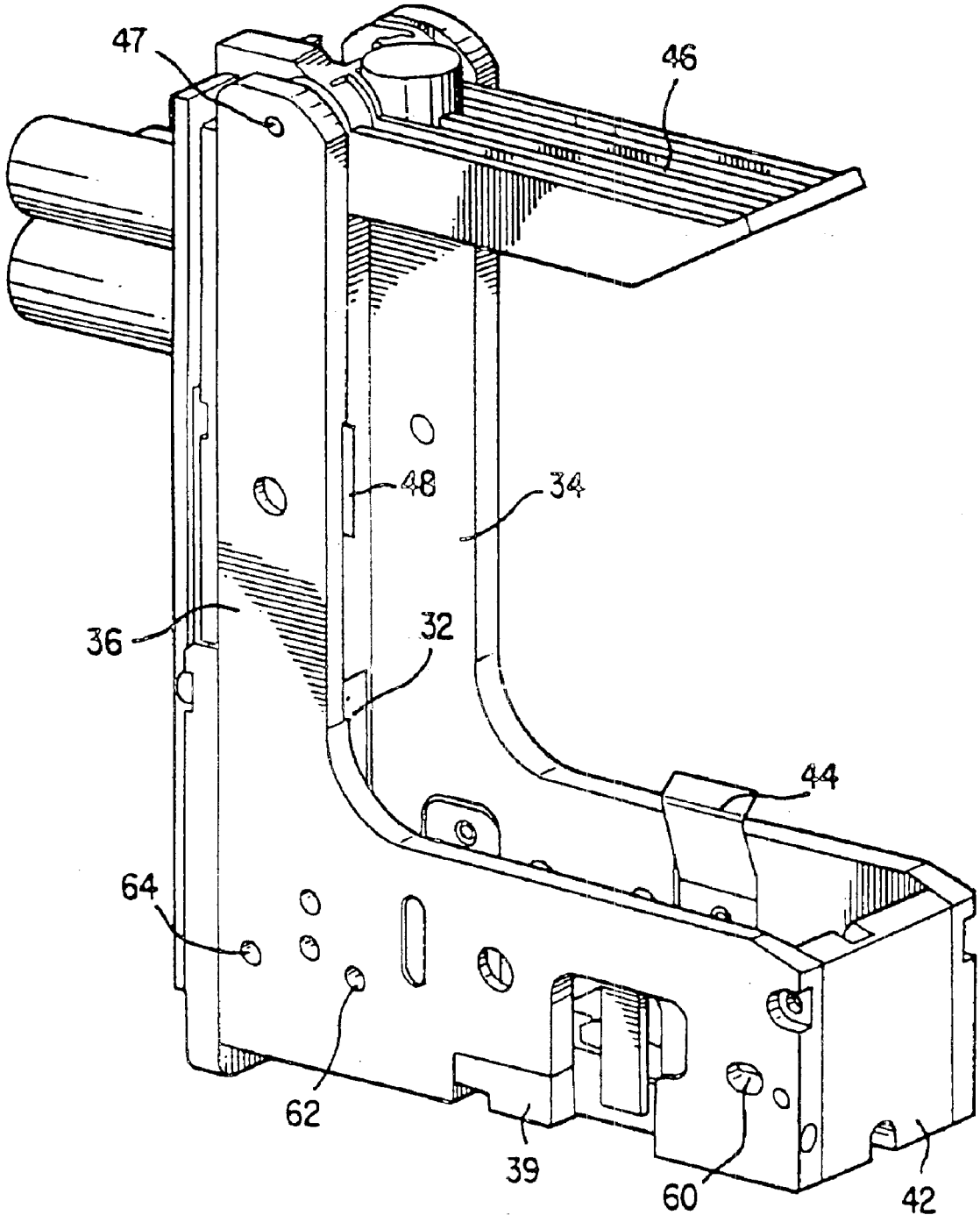
FIG. 4 is a perspective front left view of a singular modular print cartridge receptacle of the present invention.

FIGS. 2, 3, and 4 are perspective front and rear views of the single modular print cartridge receptacle 30 of the present invention. The modular print cartridge receptacle 30 includes a right sidewall 34, a left sidewall 36 and a back wall 38 rigidly attached to sidewalls 34, 36. Back wall 38 contains the electrical connections, or electrodes 32, a print cartridge driver circuit, or print ASIC 48, and electrical pin connectors 49 for electrical connection to a printer controller. Additional details of the front and back, or outside and inside of back wall 38 is described below in reference to FIG. 5. The modular print cartridge receptacle 30 also includes a partial bottom 39 attached to a portion of right sidewall 34 and left sidewall 36 to maintain rigidity of sidewalls 34, 36 and a datum reference surface. The bottom has an opening for snout 15 of print cartridge 10 and has a datum mating surface for engaging datum 27 on print cartridge 10 when print cartridge 10 is installed in the modular receptacle 30, thereby providing precise printhead to print media spacing. Optionally, modular receptacle 30 may also have a front wall 42 for providing further rigidity of the modular receptacle.

Figure 5A:
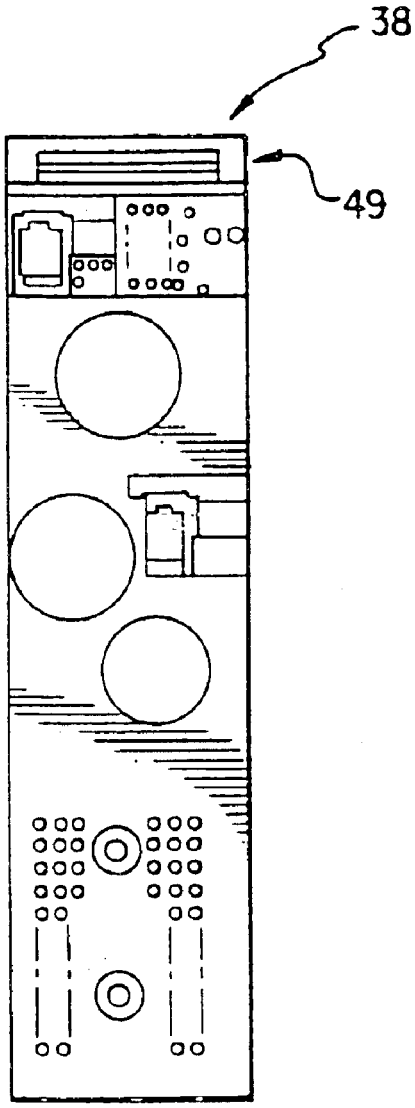
FIG. 5 is a view of the front and back walls of the modular print cartridge receptacle removed from the modular print cartridge receptacle.
Figure 5B:
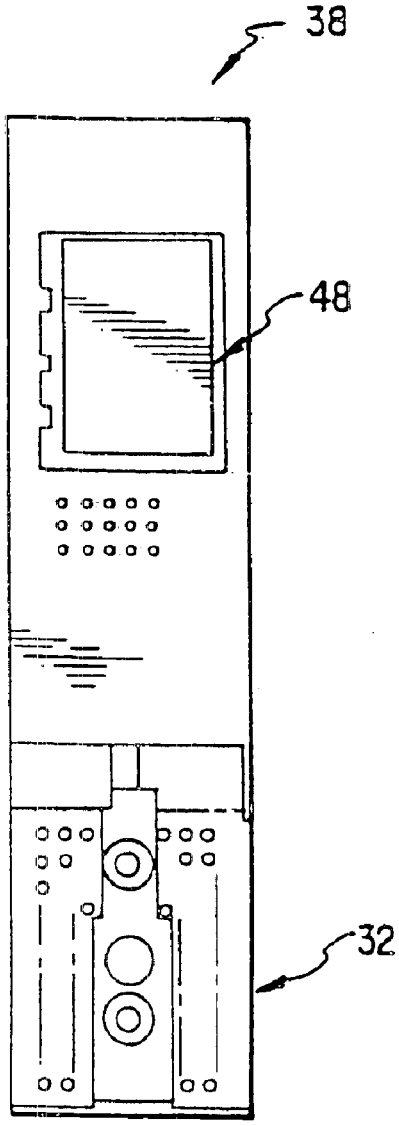

Referring to FIG. 5(*b*), back wall 38 has electrodes 32 mounted on the inside wall of back wall 38. The modular print cartridge receptacle 30 is designed so that when print cartridge 10 is installed in modular print cartridge receptacle 30, the contact pads 20, on the flexible circuit 18 of the print cartridge, align with and make contact with electrodes 32 on modular print cartridge receptacle 30 when the print cartridge 10 is installed in the modular print cartridge receptacle. The electrodes provide externally generated energization signals to the print cartridge 10. Preferably, the electrodes 32 on modular print cartridge receptacle 30 are resiliently biased toward the contact pads 20 on print cartridge 10 to ensure a reliable contact. Such electrodes are found in U.S. Pat. Nos. 5,608,434, 5,461,482, 5,372,512 and 5,684,518 all assigned to the present assignee and incorporated herein by reference.

As shown in FIG. 5(*b*), the modular print cartridge receptacle 30, also contains a print ASIC, or integrated circuit, dedicated to and mounted on the modular print cartridge receptacle. While the print ASIC may be mounted anywhere on the modular print cartridge receptacle, preferably, the print ASIC is mounted on the back wall 38 ease of electrical connection. The print ASIC interprets signals from a printer controller and delivers control signals to the electrodes 32 which in turn provide control signals to the print cartridge 10. As shown in FIG. 5(*a*), the modular print cartridge receptacle 30 also contains electrical connectors 49 for connection to a printer preferably, the electrical connectors 49 are mounted on the back wall 38 for ease of electrical connection.

When using a printhead with a large number of nozzles and high resolution, correct alignment of all the nozzles so that the ink is correctly placed on the print media is extremely important. Dot alignment must be done in both the horizontal and vertical axes. This requires the nozzle plates on all the print cartridges be aligned precisely with respect to one another after being installed in the modular receptacle and after the modular receptacles are assembled together. In a preferred alignment method, alignment between two or more nozzle plates affixed to print cartridges installed in modular print cartridge receptacle 30 is achieved by machining the datum projections 24–27 on each print cartridge 10 after its nozzle plate has been permanently secured to the print cartridge. The machined datum projections on the print cartridge contact surfaces on the modular print cartridge receptacle when the print cartridge is installed in the modular print cartridge receptacle such that the dimensions of the datums affect the position of the cartridge, and hence the nozzle plate, within the modular print cartridge receptacle.

Modular print cartridge receptacle 30 has one or more leaf springs 44 attached to right sidewall 34 of modular print cartridge receptacle 30. The cantilevered leaf springs 44 provide a sideways force. The leaf spring 44 in its uncompressed condition does not lie flat against sidewall 34, but extends into the interior of modular print cartridge receptacle 30. Accordingly, leaf springs 44 provide a sideways right to left bias force on the print cartridge 10 toward datum mating surfaces on the interior of left sidewall 36 that align with and engage the three datum surfaces 26 on the print cartridge 10.

The print cartridge can be secured within the modular print cartridge receptacle 30 by a locking mechanism, such as a hinged latch 46 which pivots about axis 47. When lowered latch 46 presses down on the latch engaging portion 28 of print cartridge 10. The latch engaging portion 28 on print cartridge 10 has an angled surface 29 between the horizontal and vertical directions for engaging with latch mechanism 46 on the modular print cartridge receptacle 30. Angled surface 29 causes print cartridge 10 to be biased both downward and leftward so as to engage datums 26 with the mating surfaces on left sidewall 36 of modular receptacle 30. Alternatively, the locking mechanism may comprise a spring assembly which movably allows the print cartridge to be snapped into the modular print cartridge receptacle 30. For further details regarding other locking mechanisms see U.S. Pat. No. 5,646,665 entitled "Side Biased Datum Scheme for Inkjet Cartridge and Carriage."

The exterior of right sidewall 34 of modular receptacle 30 contains alignment projections 50, 52 and 54 and left sidewall 36 of modular receptacle 30 contains alignment openings 60, 62 and 64. Alignment projections 50, 52 and 54 and alignment openings 62 and 64 are round and alignment opening 60 is oval shaped. The alignment projections and alignment openings are shown as round or oval shaped, but any other suitable shape for the alignment projections and alignment openings may be used. Alignment projections 50, 52 and 54 and alignment openings 60, 62 and 64 are used for joining and aligning two or more modular receptacles 30 together as discussed below.

The modular print cartridge receptacles 30, in addition to providing mechanical alignment and electrical interconnection also provides other functionalities through the print driver ASIC located on the modular print cartridge receptacle. These functionalities include: (1) controlled and accurate pulse firing energy for the print cartridge, (2) electrical pulse driving, (3) automatic pulse warming, (4) ambient temperature measurement, (5) printhead temperature measurement, (6) ESD protection (7) detection of, and protection from, open circuit and shorts, and (7) other servicing functions normally used to support inkjet print cartridges. These integrated features of modular print cartridge receptacle 30 allow for the easy development of specialized printing systems without the need for a thorough knowledge of thermal inkjet technology. Accordingly, the specialized printing system must only perform the following functions: (1) set the print cartridge firing energy level (the print driver ASIC ensures accurate deliver of that energy level), (2) set the firing order of the print cartridge, (3) set the time when the print cartridge is fired by providing a logic timing signal along with which nozzles are to be fired, and (4) set the pulse width of the firing pulse.

For additional details regarding print cartridge control see U.S. patent application Ser. No. 08/958,951, filed Oct. 28, 1997, entitled "Thermal Ink Jet Print Head and Printer Energy Control Apparatus and Method," U.S. Pat. No. 5,418,558, entitled "Determining the Operating Energy of a Thermal Ink Jet Printhead Using an Onboard Thermal Sense Resistor;" U.S. Pat. No. 5,428,376, entitled "Thermal Turn on Energy Test for an Inkjet Printer;" and U.S. Pat. No. 5.682,185 entitled "Energy Management Scheme for an Ink Jet Printer;" The foregoing commonly assigned patents and patent applications are herein incorporated by reference.

Figure 6:
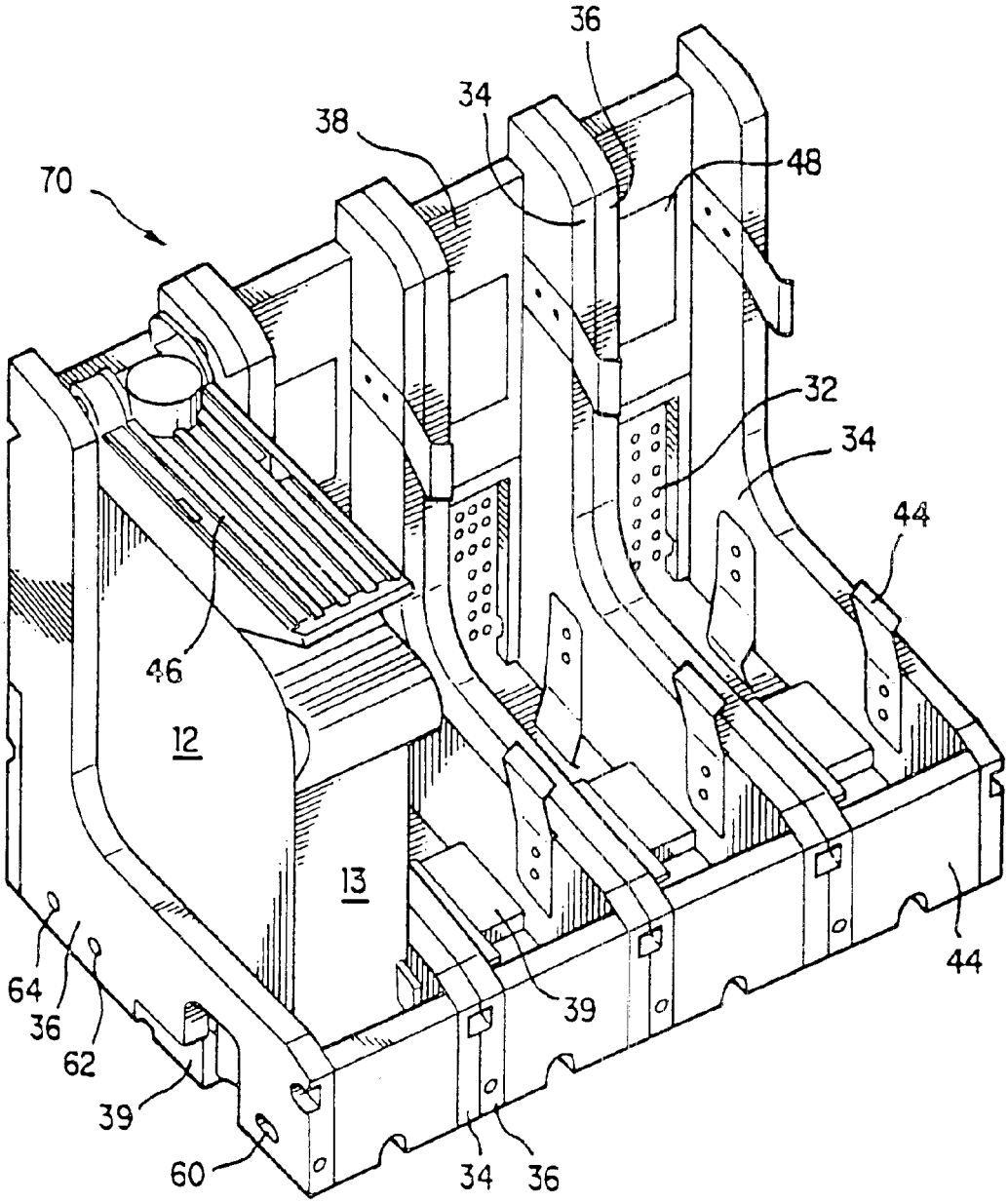
FIG. 6 is a perspective view of four modular print cartridge receptacles assembled in an aligned arrangement into a modular print cartridge receptacle assembly and showing one print cartridge installed in the modular assembly.

The modular print cartridge receptacles 30 may assembled in various configurations, only some of which are described below. One skilled in the art will readily see other possible combinations. First, modular print cartridge receptacles 30 may be assembled in an aligned arrangement into a modular print cartridge receptacle assembly 70. To assemble modular print cartridge receptacles assembly 70 in an aligned arrangement, alignment projections 50 and 54 are aligned and inserted into alignment openings 60 and 64, respectively, in the exterior left sidewall 36 of a second modular receptacle 30. FIG. 6 is a perspective view of four modular print cartridge receptacles 30 assembled in an aligned arrangement into a modular print cartridge receptacle assembly 70 and showing one print cartridge installed in the modular assembly.

Figure 7:
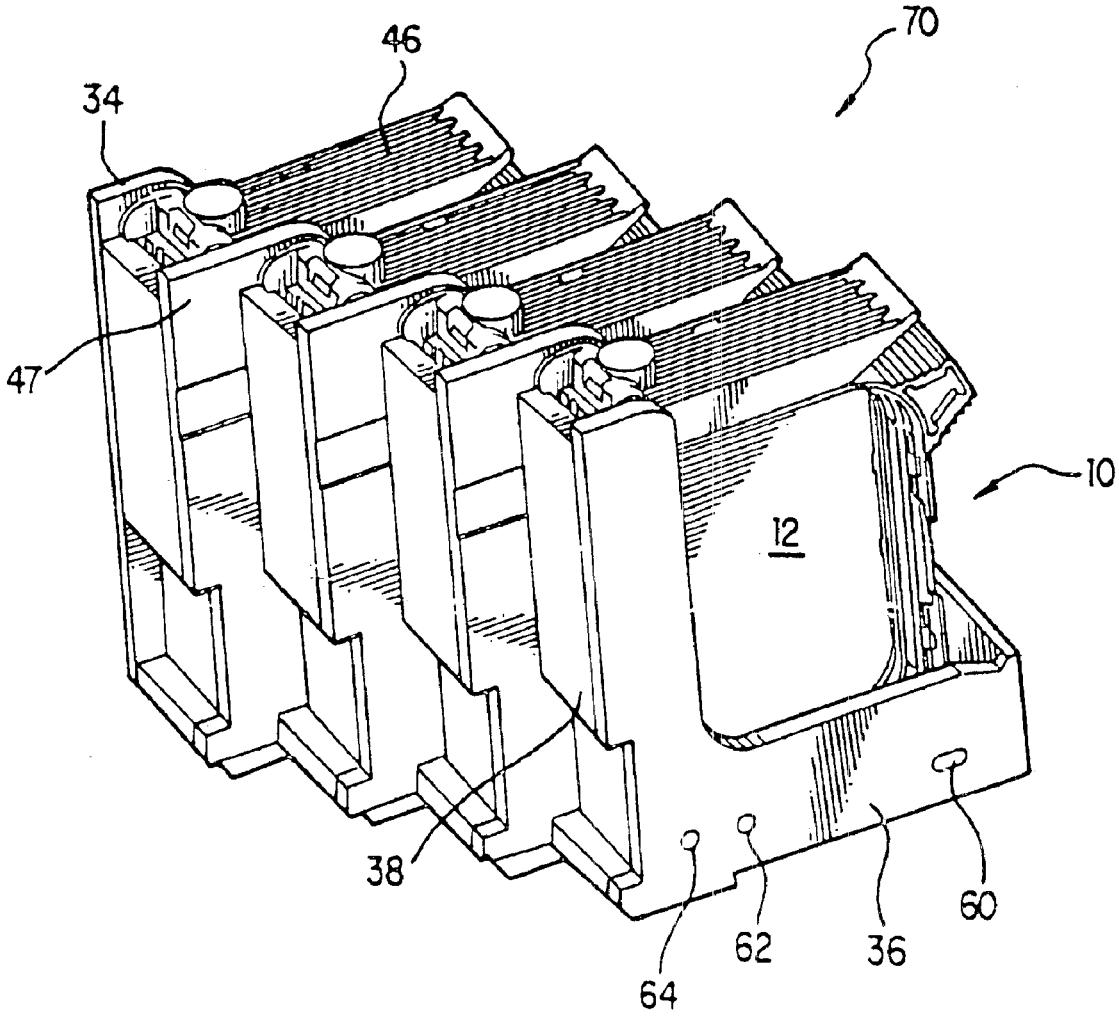
FIG. 7 is a perspective view of four modular print cartridge receptacles assembled in a staggered arrangement into a modular print cartridge receptacle assembly.

Second, modular print cartridge receptacles 30 may be assembled in a staggered arrangement into a modular print cartridge receptacle assembly 70. To assemble modular print cartridge receptacles assembly 70 in an aligned arrangement, alignment projections 52 and 54 are aligned and inserted into alignment openings 60 and 62, respectively, in the exterior left sidewall 36 of a second modular receptacle 30. FIG. 7 is a perspective view of four modular print cartridge receptacles assembled in a staggered arrangement into a modular print cartridge receptacle assembly. Precise alignment of the nozzle plates on different cartridges installed in different modular receptacles 30 is achieved by the precise location of alignment projections 50, 52 and 54 and alignment openings 60, 62 and 64.

The present invention makes the alignment between print cartridges simple and inexpensive since the print cartridge 10 machined datums 24–27 align print cartridge 10 precisely in modular receptacle 30 as described above. Accurate alignment between print cartridges located in adjacent modular receptacles 30 after assembly into a modular print cartridge assembly 70 is achieved by the precise alignment features of alignment projections 50, 52 and 54 and alignment openings 60, 62 and 64.

Modular print cartridge receptacles 30 may be assembled together in various configurations including combinations of both staggered and aligned modular print cartridge receptacles 30. Modular print cartridge receptacles 30 may be assembled together with either monochrome or multiple color ink print cartridges depending upon the printing system. FIG. 8 is a plan view of some different possible assembled configurations of modular print cartridge receptacles 30 and associated print cartridges as viewed upward from below the print cartridges to show the nozzle array 16. In an aligned arrangement, the each orifice, or nozzle 17 in nozzle array 16 is aligned with the corresponding nozzle in the other print cartridges 10. In a staggered arrangement, the orifices 17 in nozzle array 16 are aligned such that the top nozzle in one print cartridge is aligned with the bottom nozzle in the adjacent print cartridge 10. Alternatively, in a staggered arrangement, the orifices 17 in nozzle array 16 are overlapped such that the top nozzles in one print cartridge is aligned with a nozzle above the bottom nozzle in the adjacent print cartridge 10. In this case electronic alignment through selective on/off control of individual nozzles may also be utilized.

FIG. 3(*a*) shows four modular print cartridge receptacles 30 and associated print cartridges 10 assembled in a fully aligned arrangement into a modular print cartridge receptacle assembly 70. Any number of modular print cartridge receptacles 30 and associated print cartridges 10 may be assembled in this arrangement and may include any colors desired. FIG. 8(*b*) shows four modular print cartridge receptacles 30 and associated print cartridges 10 assembled in a fully staggered arrangement into a modular print cartridge receptacle assembly 70 having a swath width essentially equal to four individual print cartridges. Obviously, any number of modular print cartridge receptacles 30 and associated print cartridges 10 could be assembled in a fully staggered arrangement to provide a desired print swath width. FIG. 8(*c*) shows eight modular print cartridge receptacles 30 and associated print cartridges 10 assembled into a combination aligned and staggered modular print cartridge receptacle assembly 70. Obviously, any number of modular print cartridge receptacles 30 and associated print cartridges 10 could be assembled as in FIG. 8(*c*) to provide a desired print swath width. The arrangements shown in FIG. 8 are merely illustrative of the many possible combinations of staggered, aligned and the number of modular print cartridge receptacles 30 assembled into a modular print cartridge receptacle assembly 70.

Accordingly, the present invention provides for variable width printing up to and including full page width printing. When using a single print cartridge for monochrome printing, the width of printing is determined by the length of the nozzle portion of the print cartridge. The present invention provides for mounting multiple print cartridges 10 through the use of modular print cartridge receptacles 30 in order to easily provide variable width printing. As many print cartridges 10 and modular print cartridge receptacles 30 may be assembled into a modular print cartridge receptacle assembly 70 as is necessary to achieve the desired print width. Greater throughput is possible by using wider print widths across the print media.

A flexible circuit (not shown) provides for transmitting electrical signals from the printing system's microprocessor to the electrical interconnects 49 on the individual modular print cartridge receptacles in the modular print cartridge receptacle assembly 70. The features of inkjet printing system 80 may include an ink delivery system from an onboard ink supply internal to the print cartridge 10 or from tubes connected to an off-axis ink supply.

Figure 9:
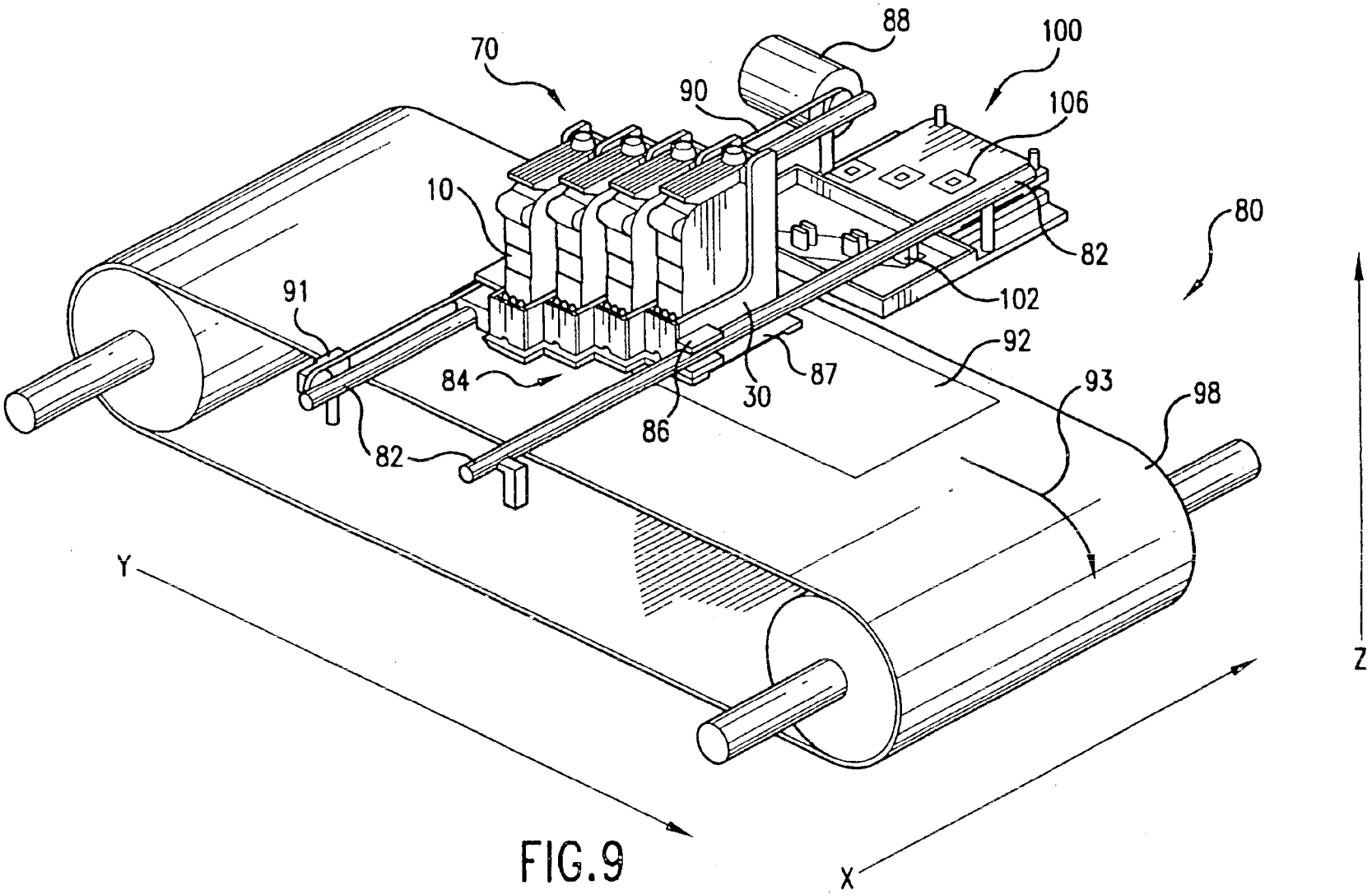
FIG. 9 is a simplified schematic perspective view of an inkjet printing system with print cartridges installed, using a belt drive media movement system.

FIG. 9 is a simplified schematic perspective view of an inkjet printing system 80 using stationary print cartridges 10 and a belt drive media movement system 98. When a printing operation is initiated, a sheet of media 92 is fed into the printing system 80 and the media is moved through a print zone 84 by a media moving mechanism 98. The print zone 84 is defined as the area beneath the nozzles 17 of the print cartridges 10 in the path of the media 92. The media moving mechanism 98 may be either a belt drive as shown in FIG. 9, drum as shown in FIG. 10, or a conventional roller drive mechanism as shown in FIG. 11.

Generally, the modular print cartridge receptacle assembly 70 contains the number of print cartridges 10 needed to print a swath of a desired width. The print cartridge assembly 70 remains stationary during the printing operation while the media 92 is passed through the print zone under the print cartridges 10 and to a position out of the print zone by the media moving mechanism 98.

Figure 10:
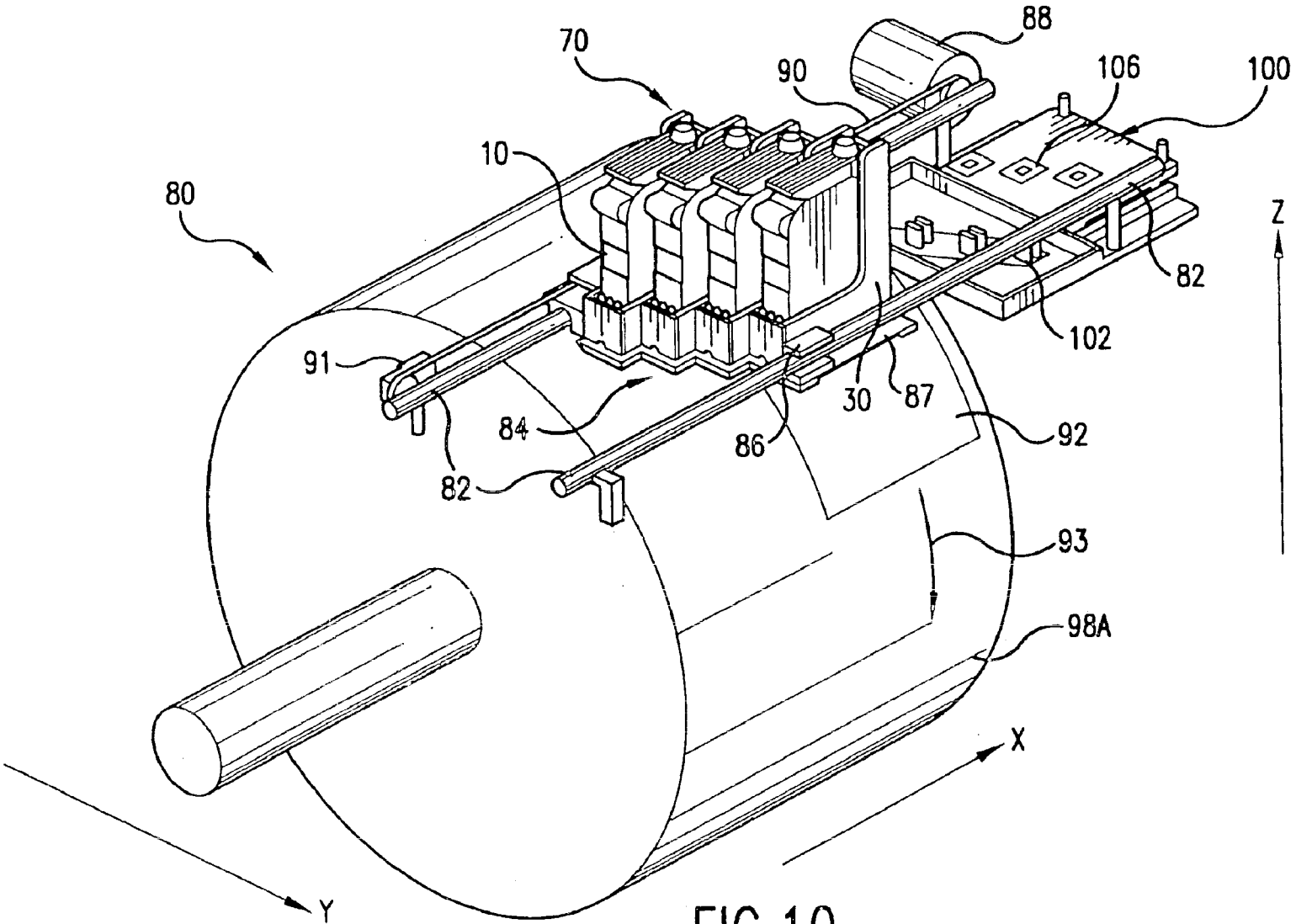
FIG. 10 is a simplified schematic perspective view of an inkjet printing system with print cartridges installed, using a drum media movement system.

FIG. 10 shows another embodiment where the media moving mechanism 98A is a rotating drum. The media 92 is temporarily held to the drum as the drum rotates the media through the print zone 84. In this embodiment the media may be moved through the print zone once, i.e., one drum rotation, or multiple times, i.e., multiple drum rotations before the media is released to an output tray (not shown). In this embodiment the modular print cartridge receptacle assembly 70 also remains stationary during the printing operation while the media 92 is passed through the print zone under the print cartridges.

Figure 11:
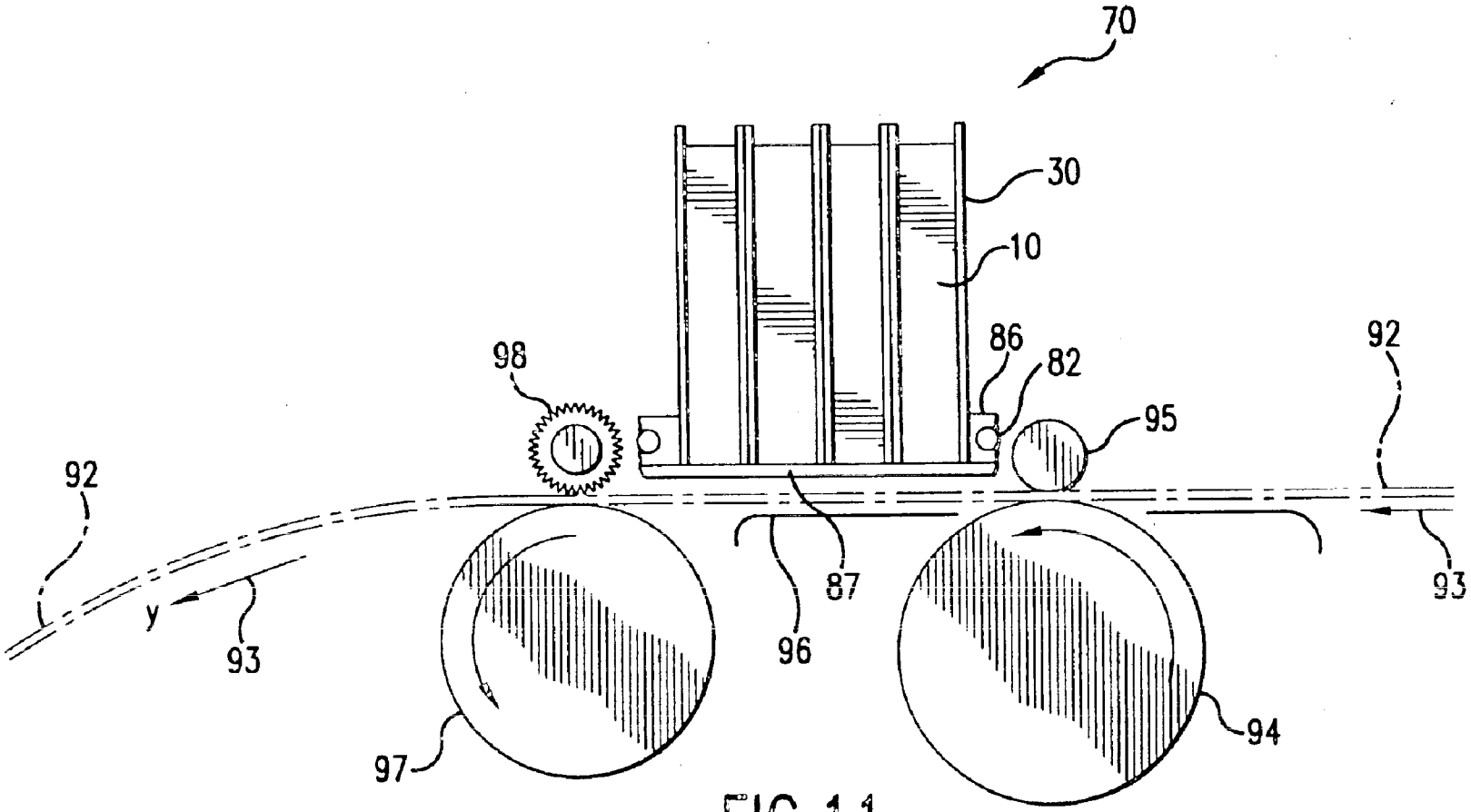
FIG. 11 is a simplified schematic perspective view of an inkjet printing system with print cartridges installed, using drive rollers as a media movement system.

FIG. 11 is a simplified schematic perspective view of a media moving mechanism 98B using a conventional roller drive media moving mechanism. The portion of the media path through the print zone under the print cartridges 10 is shown with the print cartridge assembly 70 and its support assembly as shown in FIGS. 9 and 10 removed for clarity of illustration. The media 92 is picked from an input tray and driven into the media path in the direction of arrow 93. The leading edge of the media 92 is then fed between a drive roller 94 and an idler or pinch roller 95 and is driven into the print zone. A member 96 supports the media 92 as it is passed through the print zone under print cartridges 10. After the media passes through the print area zone it encounters an output roller 97 and star wheel which propel the media 92 into an output tray (not shown). A star wheel is used so that its pointed edges can pull the media at the printed surface without smearing.

The present invention enables the print cartridges on printers using stationary print cartridges to be accessed by service station components such as wipers, scrapers, cleaning fluid applicators, ink receiving receptacles and cappers. The advantage of the present invention is that enables the print cartridges on stationary printhead printing system to be serviced in a manner similar to what is done in a conventional scanning printhead printing better. The benefits of correctly servicing the inkjet print cartridges are increased printhead quality, increased printhead life, more consistent performance over a wide range of environmental conditions, and reduced operator intervention such as manually cleaning and replacing print cartridges.

The present invention involves relocating the print cartridges on a printing system wherein the print cartridges are stationary during printing to a service station by combining linear and rotational motion in one or more of the directions X, Y, Z, $\theta_X$, $\theta_Y$, and $\theta_Z$ in a Cartesian coordinate system. Any combination of X, Y, Z, $\theta_X$, $\theta_Y$ and $\theta_Z$ movements could be implemented to relocate the print cartridges for servicing. The print cartridges are only relocated when required for servicing.

Figure 12:
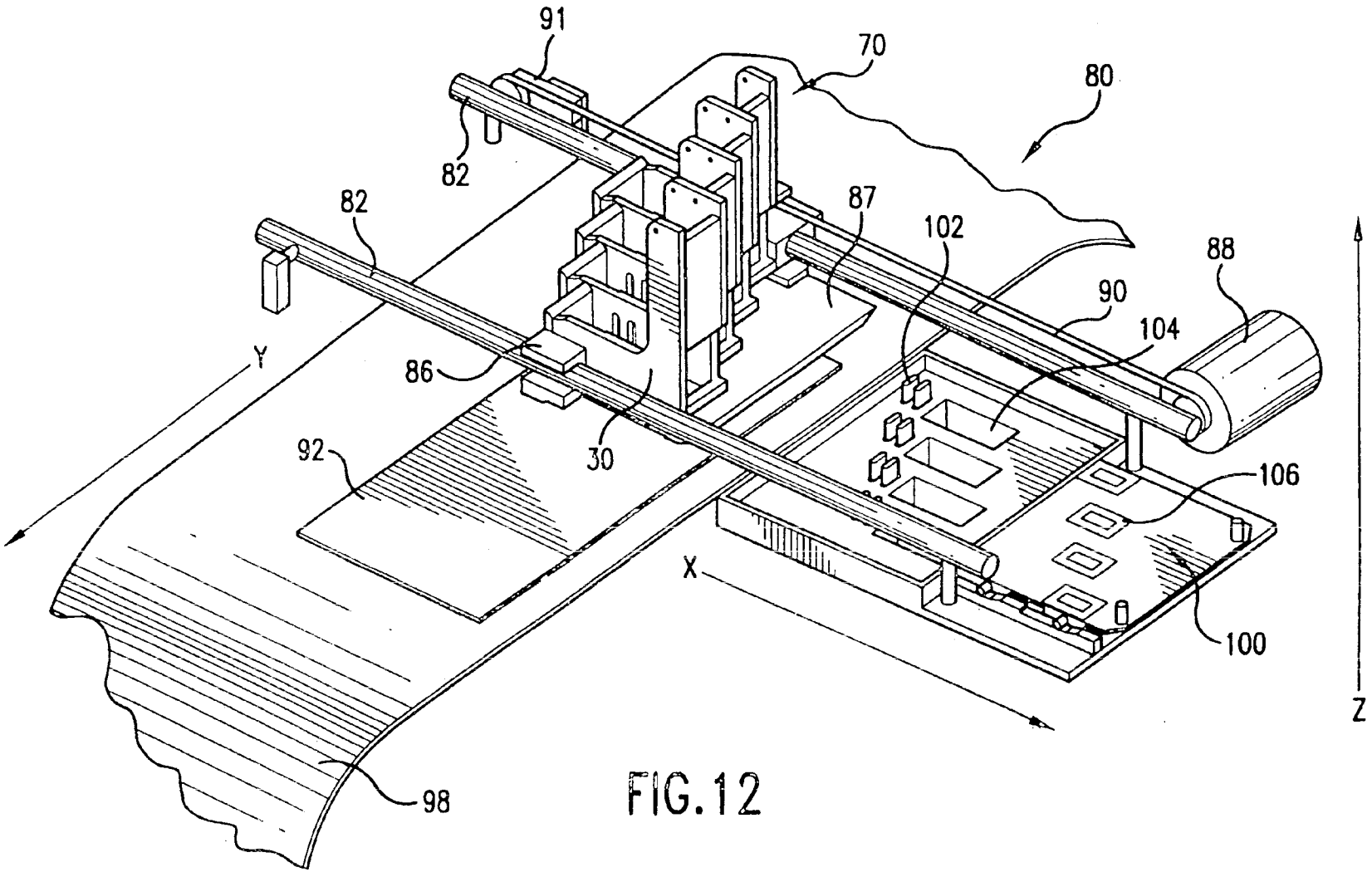
FIG. 12 is a simplified schematic perspective view of an inkjet printing system showing x-axis movement of the print cartridge assembly to a service station.

FIG. 12 is a simplified schematic perspective view of the inkjet printing system of FIG. 9 without print cartridges installed, showing the print cartridge service station 100 in further detail. Referring to FIGS. 9, 10 and 12, a mechanism for moving modular print cartridge assembly 70 generally may include slide rods or rails 82 along which modular print cartridge receptacle assembly 70 moves back and forth through the print zone 84 and out of the print zone to the service station 100. Modular print cartridge receptacle assembly 70 is may be movably attached to slide rod 82 with a split bushing 86, or any other suitable means of attachment. Alternatively, the bottom of the modular print cartridge receptacle assembly 70 can be mounted to a horizontal base 87 to which bushing 86 may be mounted. It will be appreciated that other means for supporting and traversing the modular print cartridge receptacle assembly 70 above the media are within the scope of the present invention. The print cartridge assembly 70 itself or the print cartridge assembly 70 and any additional means for supporting the modular print cartridge assembly 70 (e.g., such as base 87) may be referred to herein as the print cartridge support structure 70.

The guide rails or rods 82 and a movement control system enable the print cartridges to be moved to a location where a service station 100 is mounted below the print cartridges 10 to perform the servicing operations. In this case the print cartridges 10 move in a direction parallel to the columns of the printhead nozzle array 16, instead of perpendicular to the columns of the printhead nozzle array 16 as in a typical scanning print cartridge system.

A motor 88 may be used to provide the capability of moving the paint cartridge assembly 70 within the print zone or out of the print zone to the service station 100. The motor 88 may be connected to a conventional drive belt 90 and pulley 91 arrangement, a screw drive mechanism (not shown), or an other similar mechanism which is connected to either the modular print cartridge receptacle assembly 70 or to the horizontal base 87. This arrangement can be used to position the modular print cartridge receptacle assembly 70 to the appropriate position 84 within the print zone and also to move the modular print cartridge receptacle assembly 70 to the print cartridge service station 100. The service station 100 includes modules for wiping 102, for spitting ink into an ink receiving receptacle 104, and for capping the print cartridge for storage 106. The service station 100 may also include additional modules for scraping the wipers and applying a cleaning fluid to the wipers. The print cartridges 10 are moved in the x-axis direction to a position above the service station 100. Movement of the print cartridges 10 provides wiping of the nozzle arrays by the wipers 102, positioning above the ink receiving receptacle 104 for receiving ink ejected by the print cartridges 10 and positioning above the capping module 106 capping the nozzle array for storage.

While in FIGS. 9, 10 and 12 the service station 100 is shown as being located orthogonal to the media path 93, it will be appreciated that the service station could be located at other angles with respect to the media path. In this case the print cartridges 10 would be counter-rotated by the same change in angle so that the columns of nozzle array 16 remain perpendicular to the media path.

For further details on service stations and their operation see the following patents, U.S. Pat. No. 5,949,453 entitled "Mixed Resolution Printing for Color and Monochrome Printers;" U.S. Pat. No. 5,450,105 entitled "Manual Pen Selection for Clearing Nozzles Without Removal from Pen Carriage;" U.S. Pat. No. 6,000,780 entitled "Wiping System for Inkjet Printer," U.S. Pat. No. 5,847,727 entitled "Wet-wiping Technique for Inkjet Printhead" U.S. Pat. No. 5,614,930 entitled "Orthogonal Rotary Wiping System for Inkjet Printheads." U.S. Pat. No. 5,886,714 entitled "Actuation Mechanism for Translational Wiping of a Stationary Inkjet Printhead;" U.S. Pat. No. 5,984,450 entitled "Independent Wiping/Spitting Station for Inkjet Printhead;" U.S. Pat. No. 5,898,445 entitled "Translational Wiping technique for a Stationary Inkjet Printhead;" U.S. Pat. Nos. 5,907,335; 5.644,346; 5,621,441 and 5,905,514 which are herein incorporated by reference.

Figure 13:
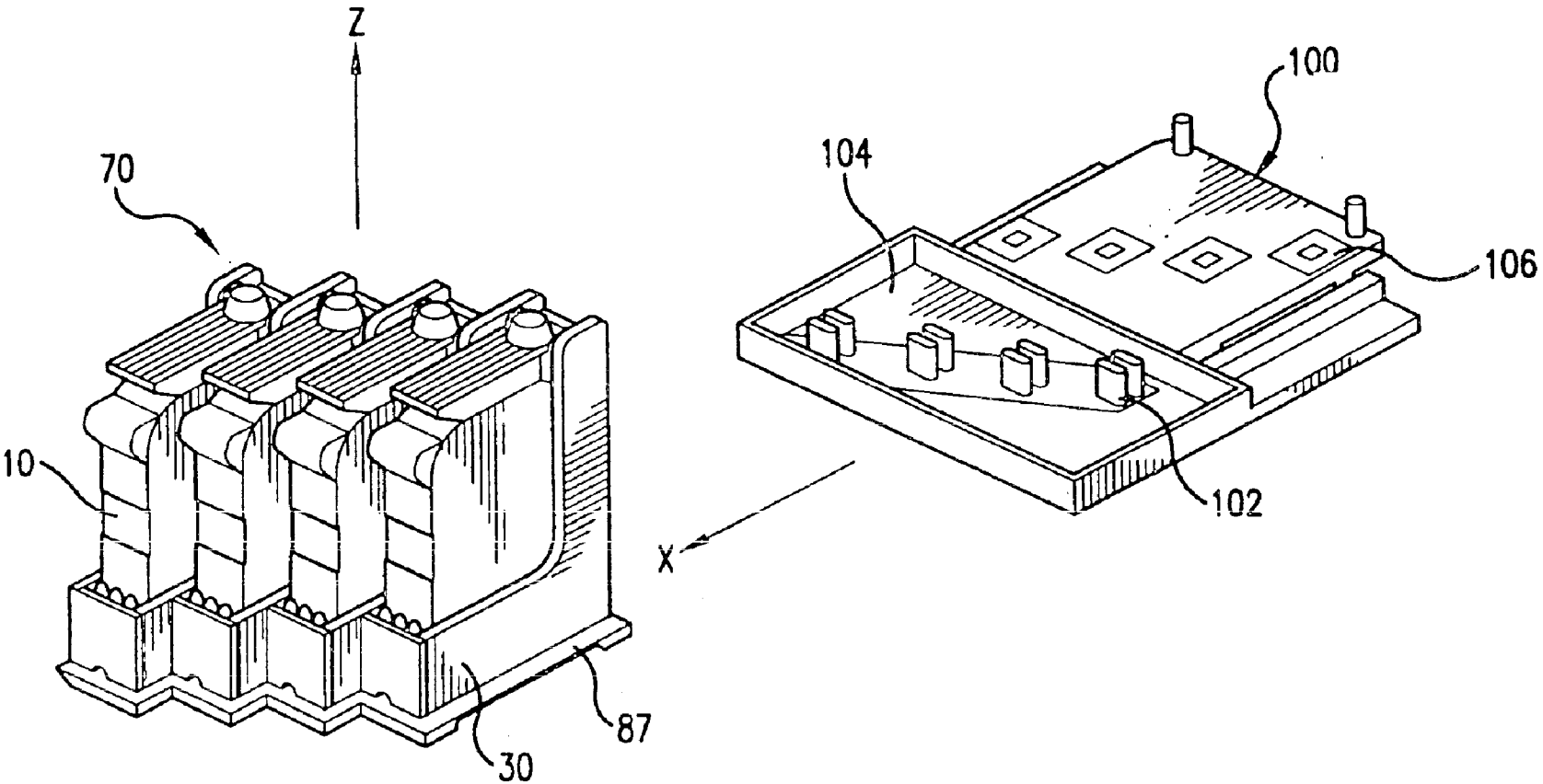
FIG. 13 is a simplified schematic perspective view of an inkjet printing system showing combined z-axis movement of the print cartridge assembly and x-axis movement of the service station.

FIG. 13 is a simplified schematic perspective view of an inkjet printing system showing combined z-axis movement of the print cartridge assembly and x-axis movement of the service station. The print cartridge assembly 70 is raised up in the z-axis direction and the service station 100 is moved in the x-axis direction under the print cartridge assembly 70. Movement of the service station 100 provides wiping of the nozzle arrays by the wipers 102, positioning above the ink receiving receptacle 104 for receiving ink ejected by the print cartridges 10 and positioning above the capping module 106 capping the nozzle array for storage.

Figure 15:
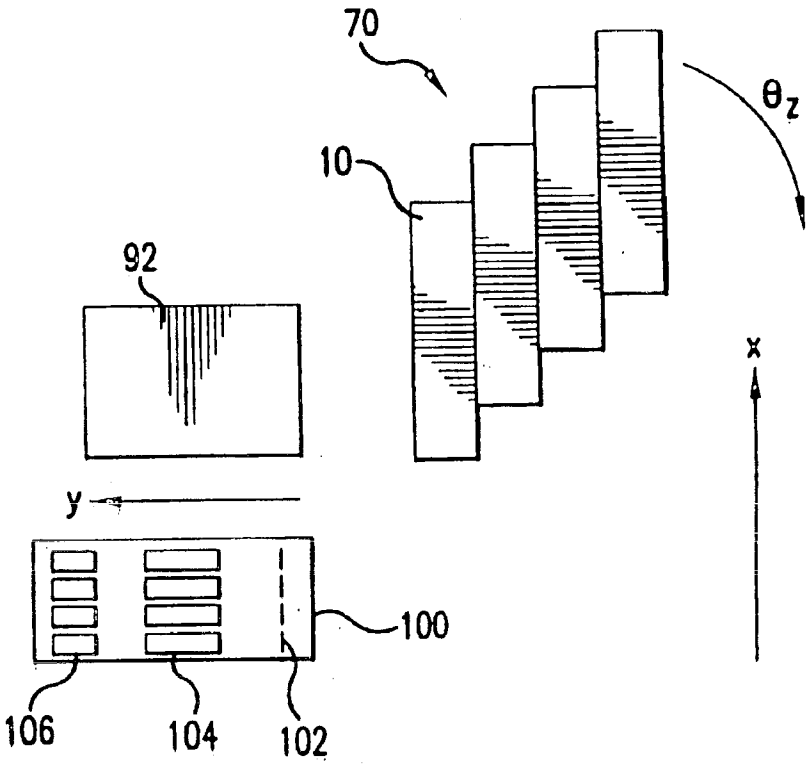
FIG. 15 is a simplified schematic perspective view of an inkjet printing system showing combined z-axis rotation of the print cartridge assembly and y-axis movement of the service station.
Figure 14:
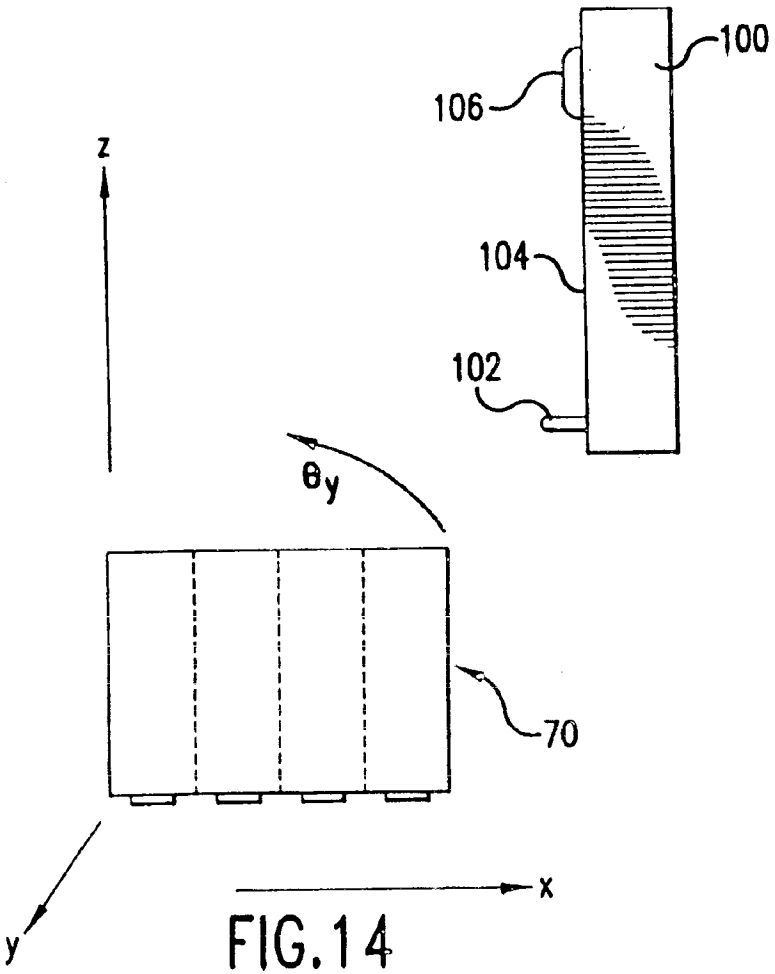
FIG. 14 is a simplified schematic perspective view of an inkjet printing system showing combined y-axis rotation of the print cartridge assembly and x-axis movement of the service station.

Others means for relocating the print cartridges by combining linear and rotational motion about different axes are shown in FIGS. 14 and 15. FIG. 14 is a simplified schematic perspective view of an inkjet printing system showing combined y-axis rotation of the print cartridge assembly and z-axis movement of the service station. The print cartridge assembly 70 is rotated 90 degrees about the y-axis so that the print cartridges 10 are horizontal. Servicing access is from the side instead of from below. The service station 100 is moved in the z-axis direction. Movement of the service station 100 provides wiping of the nozzle arrays by the wipers 102, positioning next to the ink receiving receptacle 104 for receiving ink ejected by the print cartridges 10 and positioning adjacent the capping module 106 capping the nozzle array for storage.

FIG. 15 is a simplified schematic perspective view of an inkjet printing system showing combined z-axis rotation of the print cartridge assembly and y-axis movement of the service station. The print cartridge assembly 70 is rotated 90 degrees about the z-axis out of the print zone. The service station 100 is moved in the y-axis direction under the print cartridge assembly 70. Movement of the service station 100 provides wiping of the nozzle arrays by the wipers 102, positioning above the ink receiving receptacle 104 for receiving ink ejected by the print cartridges 10 and positioning above the capping module 106 capping the nozzle array for storage.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. An inkjet printing system, comprising:

a print cartridge support structure for holding one or more print cartridges in a stationary position while applying ink on a media;

a printhead on each of said print cartridges, said printhead having nozzles for ejecting ink arranged in a nozzle array of one or more columns of nozzles;

a media movement mechanism for providing movement of the media through a print zone located beneath said nozzle array;

a printhead servicing station located outside of said print zone, said servicing station having one or more servicing modules dedicated for interaction with one of said nozzle arrays when said one of said nozzle arrays is positioned in aligned proximity with its dedicated servicing module; and a motorized device coupled to said print cartridge support structure for linearly moving the print cartridge support structure out of the print zone to said service station during a period when said print cartridges are not applying ink to said media.

2. The system of claim 1 wherein the nozzle array includes two or more columns of nozzles positioned in a parallel aligned arrangement.

3. The system of claim 1 wherein the nozzle array includes two or more columns of nozzles positioned in a parallel staggered arrangement.

4. The system of claim 1 further comprising a plurality of rails extending from the print zone to said service station.

5. The system of claim 4 wherein said print cartridge support structure is slidably coupled to said plurality of rails for linearly moving the print cartridge support structure out of the print zone to said service station.

6. The system of claim 4 wherein said print cartridge support structure is movably attached to said plurality of rails using one or more bushings.

7. The system of claim 1 wherein said one or more servicing modules is selected from a group consisting of a wiping module, an ink module, a capping module, a scraping module, and a cleaning module.

8. An inkjet printing system, comprising:

one or more print cartridges including ink to be applied onto a media;

a print cartridge support structure maintaining said one or more print cartridges in a substantially fixed position;

a plurality of printheads each fluidically coupled with one of said one or more print cartridges, each of said plurality of printheads including a nozzle array of one or more columns of nozzles;

a media movement device that moves the media to create a print zone located beneath said nozzle array;

at least one servicing module located outside of said print zone, the at least one servicing module dedicated for interaction with one of said nozzle arrays when said one of said nozzle arrays is positioned in aligned proximity with its dedicated servicing module; and a drive mechanism that moves said print cartridge support structure along a linear path out of said print zone to said service station during a period when said one or more print cartridges are not applying ink to said media.

9. The system of claim 8 wherein said nozzle array includes two or more columns of nozzles positioned in a parallel aligned arrangement.

10. The system of claim 8 wherein said nozzle array includes two or more columns of nozzles positioned in a parallel staggered arrangement.

11. The system of claim 8 further comprising a plurality of rails extending from said print zone to said service station.

12. The system of claim 11 wherein said print cartridge support structure is slidably coupled to said plurality of rails and said drive mechanism moves said print cartridge support structure from said print zone to said service station along said plurality of jails.

13. The system of claim 11 wherein said print cartridge support structure is movably attached to said plurality of rails using one or more bushings.

14. The system of claim 8 wherein said one or more servicing modules is selected from a group consisting of a wiping module, an ink module, a capping module, a scraping module, and a cleaning module.

15. An inkjet printing system, comprising:

one or more print cartridges including ink to be applied onto a media;

a print cartridge support structure maintaining said one or more, print cartridges in a substantially fixed position;

a plurality of printheads each fluidically coupled with one of said one or more print cartridges, each of said plurality of printheads including a nozzle array of one or more columns of nozzles;

a media movement system that moves the media on a media path to create a print zone located beneath said nozzle array;

at least one servicing module located outside of said print zone, the at least one servicing module dedicated for interaction with one of said nozzle arrays when said one of said nozzle arrays is positioned in aligned proximity with its dedicated servicing module; and means for moving the print cartridge support structure in a substantially linear path from said print zone to said service station during a period when said one or more print cartridges are not applying ink to said media.

16. The system of claim 15 wherein said means for moving comprises a plurality of rails extending from said print zone to said service station.

17. The system of claim 16 wherein said print cartridge support structure is slidably coupled to said plurality of rails.

18. The system of claim 15 wherein said at least one servicing module is positioned orthogonal to said media path.

19. The system of claim 15 wherein said one or more servicing modules is selected from a group consisting of a wiping module, an ink module, a capping module, a scraping module, and a cleaning module.

20. The system of claim 15 wherein said media movement system is selected from a group consisting of a belt drive, a drum, and a roller drive mechanism.

* * * * *

UNITED STATES PATENT AND TRADEMARK OFFICE

CERTIFICATE OF CORRECTION

PATENT NO. : 6,890,056 B2
APPLICATION NO. : 10/335122
DATED : May 10, 2005
INVENTOR(S) : Eric Joseph Johnson et al.

Figure 8A:
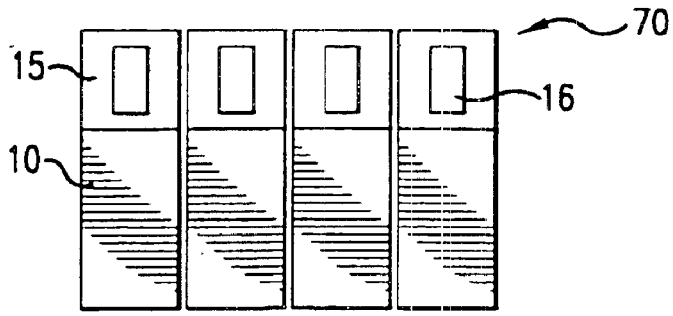
FIG. 8 is a plan view of some different possible assembled configurations of modular print cartridge receptacles 30 and associated print cartridges as viewed upward from below the print cartridges to show the nozzle array 16.
Figure 8B:
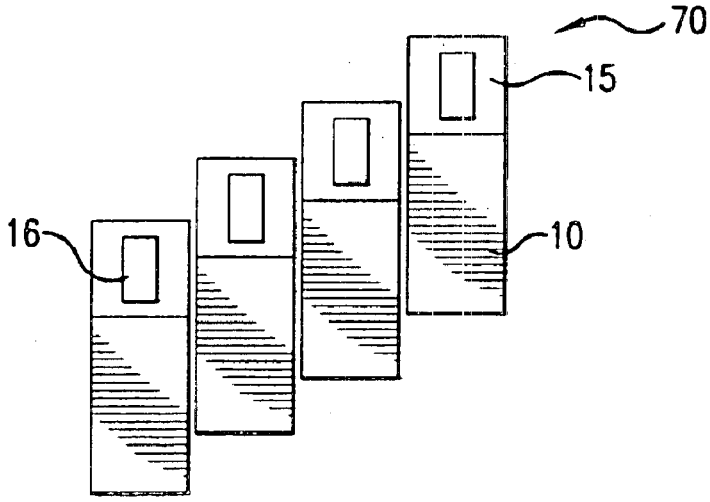
Figure 8C:
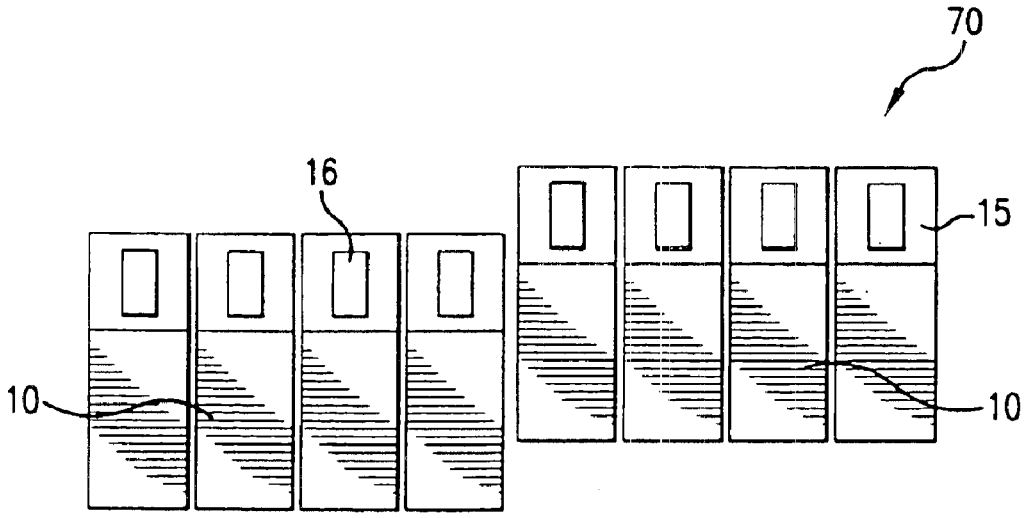

It is certified that error appears in the above-identified patent and that said Letters Patent is hereby corrected as shown below:

Column 9, line 39, delete "FIG. 3(a)" and insert therefor --FIG. 8(a)--

Claim 12, Column 14, line 20, delete "jails" and insert therefor --rails--

Claim 15, Column 14, line 32, after "more" delete ","

Signed and Sealed this

Twenty-seventh Day of May, 2008

JON W. DUDAS
*Director of the United States Patent and Trademark Office*